US005625905A

United States Patent [19]

Woods

[11] Patent Number: 5,625,905

[45] Date of Patent: May 6, 1997

[54] URINE DEFLECTOR

[76] Inventor: Michael C. Woods, 808 Williams St., Copperas Cove, Tex. 76522

[21] Appl. No.: 519,724

[22] Filed: Aug. 28, 1995

[51] Int. Cl.[6] ..... E03D 9/00

[52] U.S. Cl. ..... 4/300.3

[58] Field of Search ..... 4/300.3, 658, DIG. 5

[56] References Cited

U.S. PATENT DOCUMENTS

| | | | |
|---|---|---|---|
| 3,071,778 | 1/1963 | Renshaw | 4/300.3 |
| 4,722,103 | 2/1988 | Kliebert | 4/658 |
| 5,216,760 | 6/1993 | Brown et al. | 4/300.3 |
| 5,373,589 | 12/1994 | Rego et al. | 4/300.3 |

*Primary Examiner*—Charles E. Phillips

[57] ABSTRACT

A new and improved urine deflector for eliminating the splatter of urine on surfaces of a toilet bowl and toilet seat when males urinate from a standing position. The invention comprises a collar having paired opposed arcuate sections and paired opposed elongated sections together forming a generally oval configuration. Further included is an inner flange disposed downward from an inner edge of the collar. The flange is in generally frictional communication with an interior edge of the toilet bowl for ease of removal, cleaning, and reinstallation. A baffle is oriented on an outer edge of a rearward arcuate section of the collar. The baffle redirects urine away from a hinged section of the toilet seat. Also included is a lip extending upwardly from the outer perimeter of the collar. Finally, the device is fabricated from an elastomeric material, preferably plastic.

1 Claim, 4 Drawing Sheets

URINE DEFLECTOR

BACKGROUND OF THE INVENTION

1. Field of the Invention

The present invention relates to a new and improved urine deflector and, more particularly, pertains to a urine deflector shield for eliminating urine splatter on the surfaces of a toilet bowl.

2. Description of the Prior Art

The use of urine deflectors is known in the prior art. More specifically, urine deflector shields heretofore devised and utilized for the purpose of eliminating urine splatter on surfaces of a toilet bowl are known to consist basically of familiar, expected, and obvious structural configurations, notwithstanding the myriad of designs encompassed by the crowded prior art which has been developed for the fulfillment of countless objectives and requirements.

The prior art discloses a large number of urine deflectors. By way of example, U.S. Pat. No. 4,979,990 issued to Chan discloses a splash suppressing toilet seat cover having folded annular and bridging inner portions.

U.S. Pat. No. 3,914,803 issued to Gregovski discloses a toilet bowl splash shield that is fastened to the toilet seat and extends downwardly on each side of the toilet bowl so that when the seat is raised, the shield forms two upstanding splash guards about the two sides of the toilet bowl.

U.S. Pat. No. 5,031,253 issued to Brendlinger discloses an anti-splash and silencing device for use in toilets having a floatable member formed from two or more layers of biodegradable paper. The paper has a graphic indicia which is imprinted thereon and a string so that the device may be positioned in the toilet bowl.

U.S. Pat. No. Des. 341,414 issued to Baker appears to disclose a splash guard for a toilet bowl.

U.S. Pat. No. 5,216,706 issued to Brown et al. discloses a splash and overspray guard for catching and transporting accumulated waste fluids and channeling the waste fluid to the water in the toilet bowl therebelow.

In this respect, the urine deflector according to the present invention substantially departs from the conventional concepts and designs of the prior art, and in doing so provides an apparatus primarily developed for the purpose of eliminating urine splatter on the surfaces of a toilet bowl.

It is therefore an object of the present invention to provide a new and improved urine deflector which has all the advantages of the prior art urine deflectors and none of the disadvantages.

It is another object of the present invention to provide a new and improved urine deflector which may be easily and efficiently manufactured and marketed.

It is a further object of the present invention to provide a new and improved urine deflector which is of a durable and reliable construction.

An even further object of the present invention is to provide a new and improved urine deflector which is susceptible of a low cost of manufacture with regard to both materials and labor, and which accordingly is then susceptible of low prices of sale to the consuming public, thereby making such a urine deflector economically available to the buying public.

Still yet another object of the present invention is to provide a new and improved urine deflector which provides in the apparatuses and methods of the prior art some of the advantages thereof, while simultaneously overcoming some of the disadvantages normally associated therewith.

Lastly, it is an object of the present invention to provide a new and improved urine deflector for eliminating the splatter of urine on surfaces of a toilet bowl and toilet seat when males urinate from a standing position. The invention comprises a collar having paired opposed arcuate sections and paired opposed elongated sections together forming a generally oval configuration. Further included is an inner flange disposed downward from an inner edge of the collar. The flange is in generally frictional communication with an interior edge of the toilet bowl for ease of removal, cleaning, and reinstallation. A baffle is oriented on an outer edge of a rearward arcuate section of the collar. The baffle redirects urine away from a hinged section of the toilet seat. Also included is a lip extending upward from the outer perimeter of the collar. Finally, the device is fabricated from an elastomeric material, preferably plastic.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Therefore, it can be appreciated that there exists a continuing need for a new and improved urine deflector shield which can be used for eliminating urine splatter on exterior surfaces of a toilet bowl. In this regard, the present invention substantially fulfills this need.

SUMMARY OF THE INVENTION

In view of the foregoing disadvantages inherent in the known types of urine deflectors now present in the prior art, the present invention provides a new and improved urine deflector shield. As such, the general purpose of the present invention, which will be described subsequently in greater detail, is to provide a new and improved urine deflector and methods which have all the advantages of the prior art and none of the disadvantages.

To attain this, the present invention essentially comprises a new and improved urine deflector for eliminating the splatter of urine on surfaces of a toilet bowl and a toilet seat when males urinate from a standing position. The invention comprises a collar having paired opposed arcuate sections and paired opposed elongated sections that together form a generally oval configuration. Further included is an inner flange disposed downward from an inner edge of the collar. The flange is in generally frictional communication with an interior edge of the toilet bowl for ease of removal, cleaning, and reinstallation. A baffle is oriented on an upper edge of a rearward arcuate section of the collar and redirects urine away from a hinged section of the toilet seat. The baffle extends upwardly from the rear outer periphery of the collar for between about 16 and 20 percent of the outer periphery. A lip extends upwardly from the front outer periphery of the collar. The lip encompasses a majority of the collar and terminates at points adjacent to the baffle. Finally, the device is fabricated from an elastomeric material, preferably plastic.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
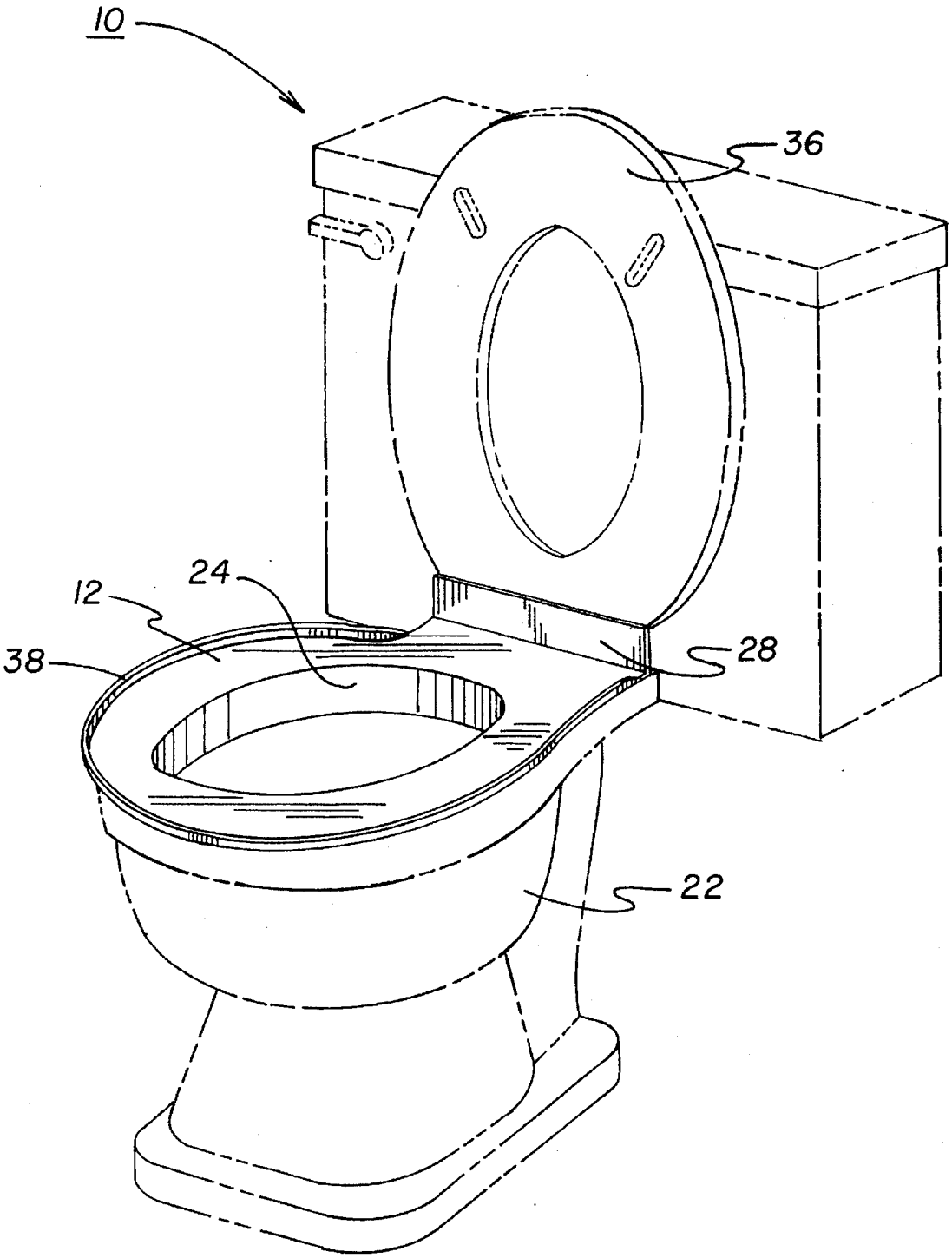
FIG. 1 is a perspective illustration of the preferred embodiment of the urine deflector shield constructed in accordance with the principles of the present invention.
Figure 2:
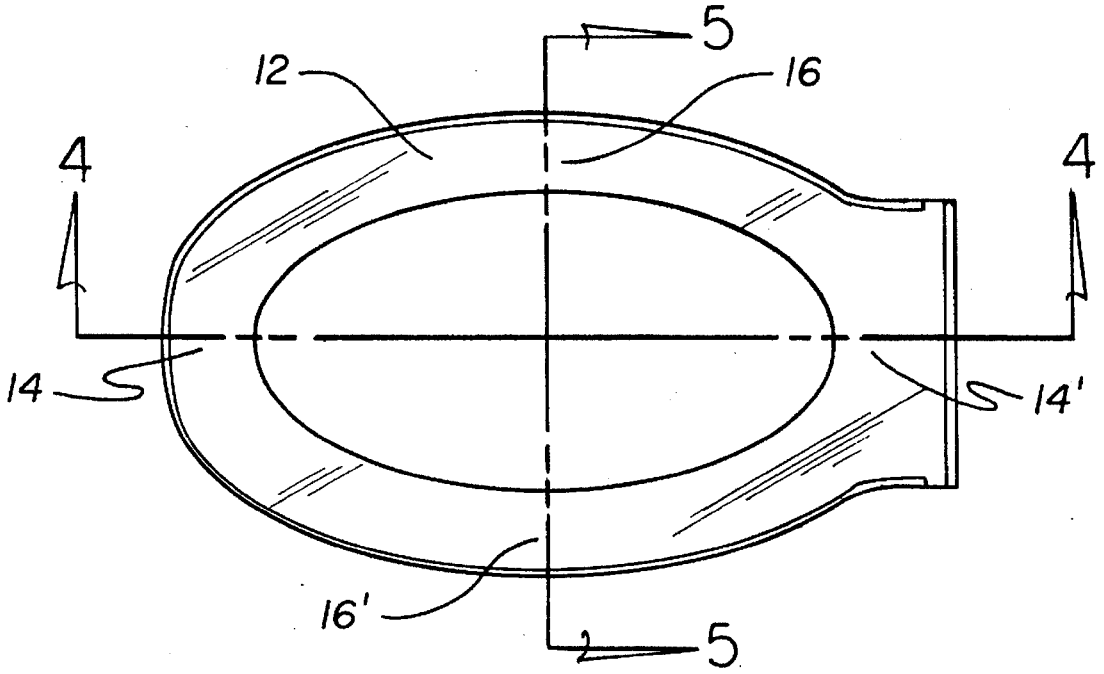
FIG. 2 is a top plan view of the invention as disclosed in FIG. 1.
Figure 3:
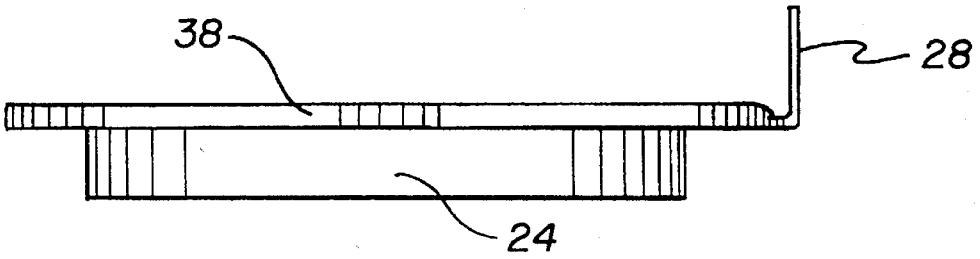
FIG. 3 is a side elevational view of the invention as disclosed in FIG. 1.
Figure 4:
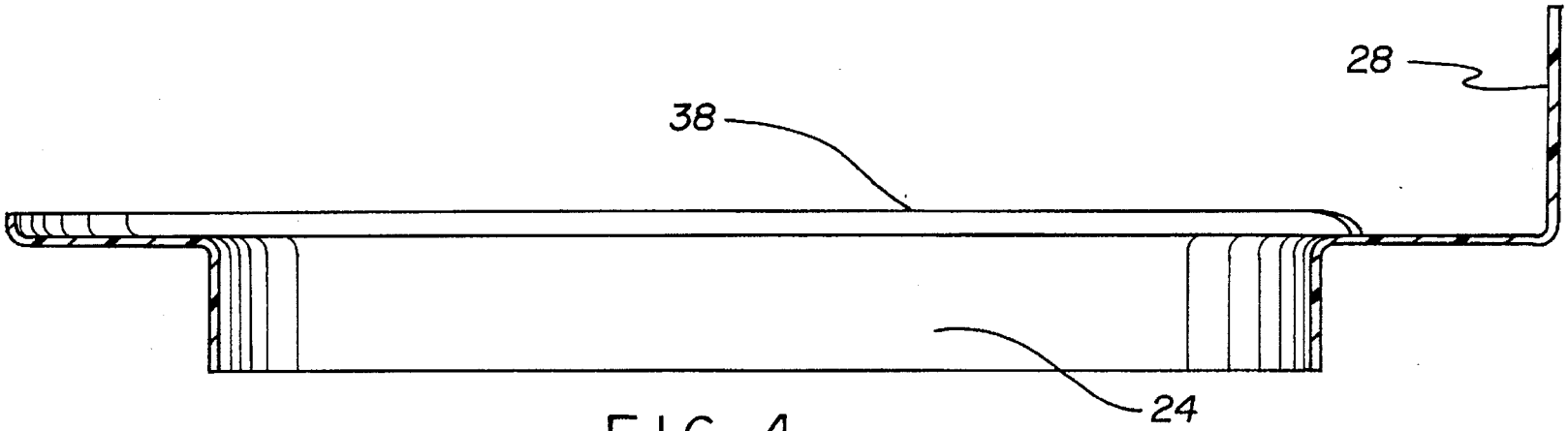
FIG. 4 is a front elevational view of the invention as disclosed in FIG. 1.
Figure 5:
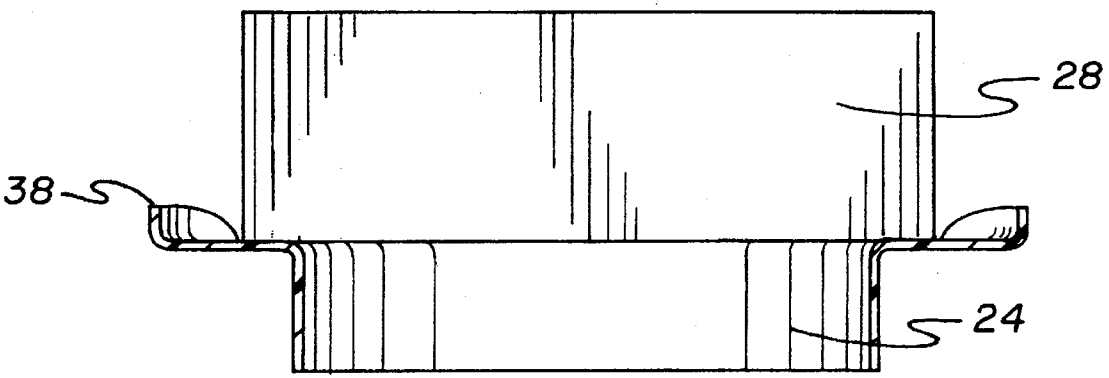
FIG. 5 is a vertical cross-sectional view taken along viewing lines 5—5 in FIG. 2.
Figure 6:
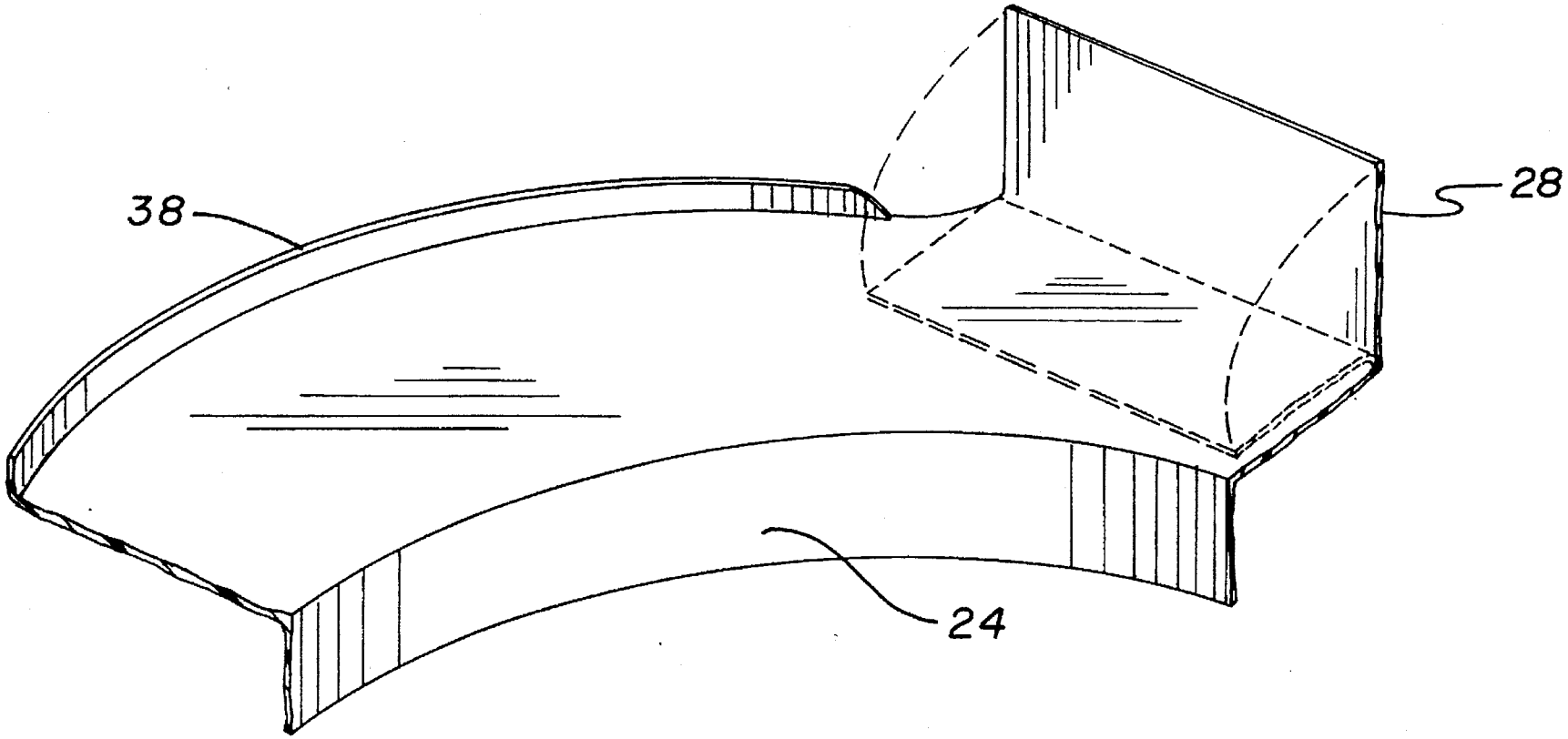
FIG. 6 is a vertical cross-sectional view taken along lines 5—5 of FIG. 2.

With reference now to the drawings, and in particular to FIGS. 1 through 6 thereof, the preferred embodiment of the new and improved urine deflector shield embodying the principles and concepts of the present invention and generally designated by the reference numeral 10 will be described.

The present invention, the new and improved urine deflector shield is a system comprised of a plurality of components. The components in their broadest context include a collar, flange, baffle, and a lip. Each of the individual components is specifically configured and correlated one with respect to the other to attain the desired objectives.

Referring generally to FIG. 1, the invention 10 is a new and improved device for eliminating the splatter of urine on exterior surfaces of a toilet bowl and a hinged section on an attached toilet seat when males urinate from a standing position. The invention is fabricated from an elastomeric material, preferably plastic.

The invention comprises a collar 12 having paired opposed arcuate sections 14, 14' and paired opposed elongated sections 16, 16' for forming a generally oval configuration. The collar has an inner oval periphery and an outer oval periphery terminating and its rear end in a linear periphery. An inner flange 24 is peripherally disposed from the inner circumference of the collar 12. The inner flange extends downward around the entire inner circumference of the collar. The flange is in generally frictional communication with an interior edge of the toilet bowl for ease of removal, cleaning, and reinstallation.

A baffle 28 is oriented on the upper edge of the linear periphery of the collar 12 such a distance so as to cover the hinged section of the toilet seat and and is adapted for redirecting urine away from a hinged section on a toilet seat 36. The baffle extends around the outer periphery for between about 16 and 20 percent of the outer periphery, preferably about 18 percent. The baffle is pivotable about the linear periphery so as to assume an upstanding position when the seat is raised and a folded position when the seat is down.

Further included is a lip 38 extending upwardly from the front outer periphery of the collar. The lip terminates at points adjacent the baffle thereby extending about a majority of the collar.

Installation of the invention is easy. The invention 10 is fitted around an interior of the toilet bowl 22. The baffle 28 is designed to fold down when the seat 36 is closed and rise up when the seat is lifted. The inner flange 24 fits around the inside of the bowl 22 and channels stray urine to the water therebelow. The invention 10 is made of a flexible plastic so that it does not interfere with the opening or closing of the toilet bowl seat 36. Also, the invention 10 is easily removed for cleaning.

In use and operation, the invention 10 is attached to the toilet bowl 22 and catches any urine that would otherwise splatter onto the outside surface of the bowl 22 or seat 36 and channels the urine into the bowl 22 and the water therebelow. When the invention 10 needs cleaning, it is merely removed from the bowl 22, cleaned and reinstalled. The baffle 28 leaves the outside surfaces of the bowl 22 clean. It has potential application in homes; institutional settings, such as hospitals or schools; public restrooms; and airplanes.

The invention provides a shield to eliminate the splatter of urine onto the outside surface of the toilet bowl when men urinate from a standing position. The invention is used on toilets to keep them clean and sanitary. The apparatus covers the horizontal opening of a toilet bowl and fits underneath the toilet seat. The invention can also be easily removed and cleaned and reinstalled when needed.

In many cases, males, and in particular juvenile males many times misdirect their urine so that it falls outside the confines of the toilet bowl. Typically, the urine is oversprayed in the area where the toilet seat is hinged. The hinge becomes discolored over time if not cleaned and in many cases must be replaced prematurely due to the discoloration. This invention will eliminate the premature replacement of toilet seats. This is a time and labor consuming process. In particular, institutions such as hospitals, schools and public facilities such as airports must maintain high levels of sanitation which requires them to change toilet seats frequently to eliminate the bacterial build up problem caused by urine overspray. Therefore, urine residue and other foreign bacteria should be prevented from accreting on the horizontal surfaces adjacent the toilet bowl, and in particular, the toilet seat hinge itself.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size materials, shape, form, function and manner of operation, assembly and use, are deemed readily apparent and obvious to one skilled in the art, and al equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved device for eliminating the splatter of urine on exterior surfaces of a toilet bowl and a hinged section on an attached toilet seat when males urinate from a standing position comprising in combination:

a collar having paired opposed arcuate sections and paired opposed elongated sections that together form a generally oval configuration, said collar having an inner oval periphery and an outer oval periphery terminating at its rear end in a linear periphery;

a flange peripherally disposed from said inner edge of the collar, the flange being in generally frictional communication with an interior edge of the toilet bowl for ease of removal, cleaning, and reinstallation, wherein the flange extends downward around an entire inner circumference of the collar;

a baffle extending upwardly from said linear periphery of the collar such a distance so as to cover the hinged section of the toilet seat and adapted for redirecting urine away from the hinged section of the toilet seat, the baffle being pivotable about said linear periphery so as to assume an standing position when the seat is raised and a folded position when the seat is down;

a lip extending upwardly from the front outer periphery of the collar, the lip extending about a majority of the outer periphery of the collar and terminating at points adjacent the baffle;

the device being fabricated from a flexible elastomeric material.

* * * * *